US009828900B2

(12) United States Patent
Takasaki et al.

(10) Patent No.: US 9,828,900 B2
(45) Date of Patent: Nov. 28, 2017

(54) OIL JET APPARATUS OF INTERNAL COMBUSTION ENGINE

(71) Applicants: Shinya Takasaki, Anjo (JP); Akihiro Ikeda, Nagoya (JP); Eiji Miyachi, Nishio (JP)

(72) Inventors: Shinya Takasaki, Anjo (JP); Akihiro Ikeda, Nagoya (JP); Eiji Miyachi, Nishio (JP)

(73) Assignees: TOYOTA JIDOSHA KABUSHIKI KAISHA, Toyota (JP); AISIN SEIKI KABUSHIKI KAISHA, Kariya (JP)

( * ) Notice: Subject to any disclaimer, the term of this patent is extended or adjusted under 35 U.S.C. 154(b) by 40 days.

(21) Appl. No.: 14/439,877

(22) PCT Filed: Aug. 28, 2013

(86) PCT No.: PCT/JP2013/072980

§ 371 (c)(1),
(2) Date: Apr. 30, 2015

(87) PCT Pub. No.: WO2014/103429

PCT Pub. Date: Jul. 3, 2014

(65) Prior Publication Data

US 2015/0292390 A1 Oct. 15, 2015

(30) Foreign Application Priority Data

Dec. 27, 2012 (JP) ..... 2012-285945

(51) Int. Cl.
*F01P 1/04* (2006.01)
*F01P 3/08* (2006.01)
(Continued)

(52) U.S. Cl.
CPC ..... *F01P 3/08* (2013.01); *F01M 1/08* (2013.01); *F01M 2001/083* (2013.01);
(Continued)

(58) Field of Classification Search
CPC ..... F01P 3/08; F02F 3/22; F01M 1/08; F02B 3/06; F05C 2201/02
(Continued)

(56) References Cited

U.S. PATENT DOCUMENTS 4,667,630 A * 5/1987 Sasaki ..... F01P 3/08 123/254
4,829,835 A * 5/1989 Welker ..... G01N 1/14 73/152.23
(Continued)

FOREIGN PATENT DOCUMENTS

CN 101265833 A 9/2008
DE 19717922 A1 10/1998
(Continued)

*Primary Examiner* — Jacob Amick
*Assistant Examiner* — Charles Brauch
(74) *Attorney, Agent, or Firm* — Oliff PLC

(57) ABSTRACT

Provided is a valve housing configured to be inserted into an insertion hole that extends in a direction approximately orthogonal to an extending direction of an oil path and configured to be freely movable along an extending direction of the insertion hole. When an oil jet switching valve is closed, the tip end portion of the valve housing is configured to be pressed to the inner wall surface of the oil path by receiving an energized force from an energizing unit.

4 Claims, 7 Drawing Sheets

(51) Int. Cl.

| | |
|---|---|
| ***F01M 1/08*** | (2006.01) |
| *F02B 3/06* | (2006.01) |
| *F02F 3/22* | (2006.01) |

(52) U.S. Cl.
CPC . *F02B 3/06* (2013.01); *F02F 3/22* (2013.01); *F05C 2201/02* (2013.01)

(58) Field of Classification Search
USPC ..... 123/41.35
See application file for complete search history.

(56) References Cited

U.S. PATENT DOCUMENTS

| | | | | |
|---|---|---|---|---|
| 2005/0152797 | A1* | 7/2005 | Sailer | F01L 13/0005 417/470 |
| 2010/0242909 | A1 | 9/2010 | Okoshi et al. | |
| 2011/0194967 | A1* | 8/2011 | Watanabe | F04C 14/226 418/138 |

FOREIGN PATENT DOCUMENTS

| | | | |
|---|---|---|---|
| DE | 19955522 | A1 | 5/2001 |
| DE | 102009038676 | A1 | 6/2011 |
| EP | 2239457 | A1 | 10/2010 |
| JP | H09-209733 | A | 8/1997 |
| JP | 2010-236439 | A | 10/2010 |
| JP | 2014-098345 | A | 5/2014 |
| KR | 20100109364 | A | 10/2010 |
| KR | 20120006592 | A | 1/2012 |

* cited by examiner

OIL JET APPARATUS OF INTERNAL COMBUSTION ENGINE

TECHNICAL FIELD

The present invention relates to an oil jet apparatus of an internal combustion engine. In particular, the present invention relates to an improvement in a mechanism of switching execution and stoppage of an oil jet.

BACKGROUND ART

Conventionally, for example, as disclosed in Patent Literature 1 and Patent Literature 2, an oil supply system that supplies engine oil (lubricating oil) to a portion to be lubricated or a portion to be cooled is provided in an engine (internal combustion engine). Also, an oil jet apparatus is connected to the oil supply system. Then, part of the engine oil discharged from an oil pump is supplied to the oil jet apparatus and injected to the rear surface side of pistons (hereinafter, this oil injection is referred to as an oil jet). The pistons are cooled by the oil jet, and for example, the occurrence of knocking can be prevented.

Also, a valve mechanism that adjusts the amount of the oil jet or switches the execution and stoppage of the oil jet is provided in the oil jet apparatus disclosed in the above-mentioned patent literatures. Specifically, a valve body that is freely movable forward and backward with respect to an oil path connected to an oil jet nozzle is provided in the valve mechanism. An energized force from a spring is applied to the valve body, and the position of the valve body is adjusted by switching the excitation and non-excitation of an electromagnetic solenoid, thereby changing the opening area of the oil path.

CITATION LIST

Patent Literature

PTL 1: Japanese Unexamined Patent Application Publication No. 1997-209733

PTL 2: Japanese Unexamined Patent Application Publication No. 2010-236438

SUMMARY OF INVENTION

Technical Problems

Incidentally, as the valve mechanism inclusive of the valve body that changes the opening area of the oil path, constitution is conceivable wherein the valve body that is movable in the direction approximately orthogonal to the extending direction of the oil path is provided, and a valve housing that guides the movement of the valve body is provided on the oil path. In this case, an opening communicated to the oil path is formed on the lateral surface of the valve housing, and the valve body is transferred forward and backward in the interior of the valve housing, thereby switching the release and closure of the opening. For example, constitution is exemplified wherein a state (closed-valve state) where the valve body is transferred forward in the interior of the valve housing, and the opening is closed, and the oil path is blocked, and a state (open-valve state) where the valve body is transferred backward, the opening is opened, and the oil path is communicated are switched by changing the excitation and non-excitation of the electromagnetic solenoid. In this case, the valve housing is fixed on the oil path by press-fitting or fastening means such as screws.

However, with this constitution, a gap is made between the tip end surface of the valve housing and the inner wall surface of the oil path due to the processing errors or the installation errors of the valve housing, and there is a possibility that the oil leaks out from the gap on the side of the oil jet nozzle. That is, even in the closed-valve state where the valve body is transferred forward (for some valve body even in a state where the opening is closed), there is a possibility that the oil leaks out to the side of the oil jet nozzle. FIG. 7B is a cross-sectional view illustrating a closed-valve state in a case where a gap c is made between the tip end surface a1 of a valve housing a and the inner wall surface b1 of an oil path b. Thus, when the gap c is made between the tip end surface a1 of the valve housing a and the inner wall surface b1 of the oil path b, the oil leaks out from the gap c on the side of the oil jet nozzle (see an arrow represented by a broken line in the diagram), even when the opening a2 of the valve housing a is closed by a valve body d.

It is an object of the present invention to provide an oil jet apparatus of an internal combustion engine, which can prevent leakage of oil in a closed-valve state to the side of an oil jet nozzle.

Solution to Problem

The present invention has a subject matter regarding an oil jet apparatus of an internal combustion engine that is configured to include an oil jet switching valve that opens and closes an oil path communicated with an oil jet mechanism. Then, the oil jet apparatus of the internal combustion engine may be constituted that the oil jet switching valve includes a valve housing configured to be inserted into an insertion hole that extends in a direction approximately orthogonal to an extending direction of the oil path and configured to be freely movable along an extending direction of the insertion hole. Also, the oil jet apparatus of the internal combustion engine may be constituted that when the oil jet switching valve is closed, a tip end portion of the valve housing is configured to be pressed to an inner wall surface of the oil path by receiving an energized force from an energizing means.

With this constitution, when the oil jet switching valve is closed, the valve housing receives the energized force from the energizing mean, and the tip end portion of the valve housing is pressed to the inner wall surface of the oil path. That is, regarding the present invention, the valve housing is not fixed in an unmovable manner, but the valve housing is provided in a freely movable manner, and the tip end portion of the valve housing is pressed to the inner wall surface of the oil path by the energized force from the energizing mean. Accordingly, when the oil jet switching valve is closed, a gap is not made between the tip end portion of the valve housing and the inner wall surface of the oil path. Consequently, it is possible to favorably secure sealability between the tip end portion of the valve housing and the inner wall surface of the oil path, thereby preventing the oil leakage to the side of the oil jet mechanism.

As one example, a recessed portion into which the tip end portion of the valve housing is fitted may be formed in the oil path.

In this manner, in a state where the tip end portion of the valve housing is pressed to the inner wall surface of the oil path by receiving the energized force from the energizing mean, the tip end portion of the valve housing fits into the recessed portion of the oil path. Accordingly, it is possible to further enhance the sealability between the tip end portion of the valve housing and the inner wall surface of the oil path.

Also, as one example, it may be constituted that a main valve body is inserted in an interior of the valve housing in a freely reciprocating manner, and the main valve body transfers forward, thereby closing an opening formed in the valve housing and blocking the oil path, whereas the main valve body transfers backward, thereby opening the opening and communicating with the oil path. Then, it may be constituted that the energized force from the energizing means in a forward transfer direction is provided for the main valve body, and when the main valve body transfers forward, the main valve body is in contact with part of an inner surface of the valve housing, thereby applying the energized force of the energizing means to the valve housing.

In this manner, the main valve body transfers forward, and only when the oil jet switching valve is closed, the energized force of the energizing means is applied to the valve housing, and the tip end portion of the valve housing is pressed to the inner wall surface of the oil path. That is, the tip end portion of the valve housing is pressed to the inner wall surface of the oil path in conjunction with the closing operation of the oil jet switching valve. Accordingly, it is possible to set the period during which the energized force is applied to the valve housing only to a period during which the application of the energized force is required, and when the oil jet switching valve is closed, it is possible to steadily press the tip end portion of the valve housing to the inner wall surface of the oil path.

Also, as one example, it may be such that a concave portion having a predetermined length dimension in a direction along an axis of the insertion hole is formed on an inner wall surface of the insertion hole, whereas a protrusion, which is positioned in the concave portion and includes a clearance provided between an inner surface of the concave portion and the protrusion in the direction along the axis, is provided on the outer wall surface of the valve housing. That is, the valve housing may be freely movable only by a dimension of the clearance along the axis in an interior of the insertion hole.

With this constitution, the valve housing can be prevented from coming off from the insertion hole. Also, the transfer range of the valve housing can be limited. Accordingly, it can be avoided that the valve housing is transferred more than necessary, and that the flow of the oil is impeded in the oil paths.

Also, as one example, constitution described below may be provided. A control valve configured to switch hydraulic pressure, which causes the main valve body inserted into the interior of the valve housing to transfer forward and backward, may be provided. The control valve may include a first port and a second port. The first port is communicated with a main oil path that supplies the oil discharged from an oil pump to the oil jet mechanism. The second port is communicated with a back pressure space of the main valve body. Then, when the control valve is in a switching state where the first port and the second port are communicated, the hydraulic pressure from the main oil path acts in the back pressure space, which causes the main valve body to transfer forward, and the opening formed in the valve housing is closed, thereby blocking the oil path. In contrast, when the control valve is in a switching state where the first port and the second port are isolated, the hydraulic pressure acted in the back pressure space is released, which causes the main valve body to transfer backward, and the opening is opened, thereby communicating with the oil path.

With this constitution, when the first port and the second port of the control valve are communicated, the hydraulic pressure in the main oil path is guided to the back pressure space of the main valve body via the first port and the second port. The main valve body is transferred forward by the action of the hydraulic pressure guided in the back pressure space and the energized force of the energizing means, thereby closing the oil path. As a result, the supply of the oil to the oil jet mechanism is stopped. In contrast, when the first port and the second port of the control valve are isolated, the hydraulic pressure in the main oil path is not guided to the back pressure space of the main valve body, which causes the main valve body to transfer backward, thereby opening the oil path. As a result, the oil is supplied to the oil jet mechanism. Thus, the hydraulic pressure acted on the main valve body is switched in conjunction with the switching operation of the control valve, which causes the main valve body to transfer forward and backward, so that the control valve only needs to include a switching function of the oil paths, as the function of the control valve, which makes it possible to realize a relatively small-size control valve. Consequently, even when the oil jet apparatus has relatively high oil consumption, the miniaturization of the oil jet apparatus can be achieved.

Also, as one example, a drain port, when the control valve is in the switching state where the first port and the second port are isolated, configured to be communicated with the second port and discharge the oil in the back pressure space may be provided in the control valve.

In this manner, when the first port and the second port are isolated, and the main valve body is transferred backward, it is possible to lower the hydraulic pressure in the back pressure space of the main valve body. Accordingly, the backward transfer of the main valve body is started approximately concurrently with the isolation of the first port and the second port, which is favorable in terms of controllability.

Advantageous Effects of Invention

According to one aspect of the present invention, when the oil jet switching valve is closed, the tip end portion of the valve housing is pressed to the inner wall surface of the oil path. Accordingly, it is possible to favorably secure sealability between the tip end portion of the valve housing and the inner wall surface of the oil path, thereby preventing the oil leakage to the side of the oil jet mechanism.

DESCRIPTION OF EMBODIMENTS

Figure 1:
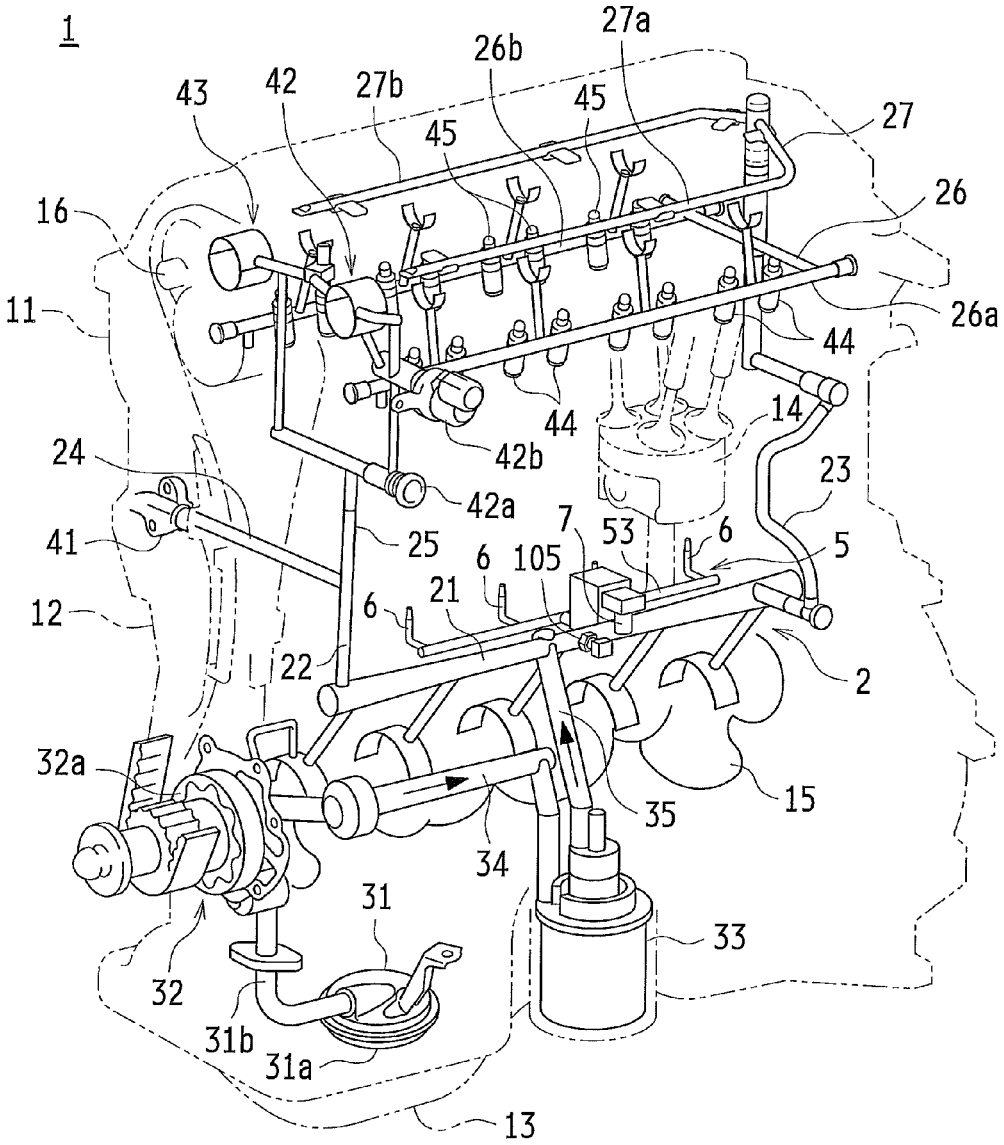
FIG. 1 is a view illustrating the schematic constitution of an oil supply system of an engine according to the present embodiment.

Hereinafter, embodiments of the present invention will be described referring to the drawings. In the present embodiment, description will be given with regard to a case where the present invention is applied to a multi-cylinder (for example, inline four-cylinder) gasoline engine for an automobile.

—Oil Supply System of Engine—

FIG. 1 is a view illustrating the schematic constitution of an oil supply system of an engine (internal combustion engine) 1 according to the present embodiments. As illustrated in FIG. 1, the engine 1 includes a cylinder head 11 and a cylinder block 12 constituting the main body of the engine, an oil pan 13 mounted on the lower end portion of the cylinder block 12, and an oil supply system 2 that circulates engine oil (hereinafter merely referred to as "oil") in the engine 1 for the internal lubrication, the internal cooling of the engine 1, and the like.

A plurality of members to be lubricated and a plurality of members to be cooled such as pistons 14, crankshafts 15, and camshafts 16 are stored in the interior of the engine 1.

Four cylinders are formed in the cylinder block 12. These cylinders are arranged in the direction (right-and-left direction in the diagram) of cylinder arrangement. The piston 14 is stored in the interior of the cylinder in a reciprocating movable manner in the up-and-down direction of the diagram.

The oil supply system 2 is constituted such that the oil accumulated in the oil pan 13 is sucked out from the oil pan 13 and supplied to the members to be lubricated or the members to be cooled, and the oil flows back from the members to be lubricated or the members to be cooled into the oil pan 13.

An oil strainer 31 that includes an inlet port 31*a* for sucking the oil accumulated in the interior of the oil pan 13 is arranged in the vicinity of the bottom portion of the oil pan 13. The oil strainer 31 is connected to an oil pump 32 provided in the cylinder block 12 via a strainer flow path 31*b*.

The oil pump 32 is constituted by a known rotary pump. The rotor 32*a* of the oil pump 32 is mechanically jointed with the crankshaft 15 in such a manner as to rotate with the crankshaft 15. The oil pump 32 is connected to the oil inlet of an oil filter 33 provided on the outside of the cylinder block 12 via an oil transport path 34. Also, the oil outlet of the oil filter 33 is connected to an oil supply path 35 provided as an oil path oriented to the members to be lubricated or the members to be cooled. It is noted that an electric oil pump may be applied as the oil pump 32.

The specific constitution of the oil supply system 2 in which the oil is supplied through the oil supply path 35 will be described below.

The oil supply system 2 is provided such that the oil pumped up from the oil pan 13 via the oil strainer 31 is supplied to each member to be lubricated by means of the oil pump 32 and used as lubricating oil, or supplied to each member to be cooled such as the piston 14 and used as cooling oil, or supplied to a hydraulic-actuated instrument and used as hydraulic oil.

Specifically, after passing through the oil filter 33, the oil, which is pressure-fed from the oil pump 32, is forwarded to a main oil hall (main gallery; main oil path) 21 extended along the direction of cylinder arrangement. Oil paths 22 and 23 that extend upward from the cylinder block 12 to the cylinder head 11 are communicated with one end side and the other end side of the main oil hall 21.

The oil path 22, which is communicated with the one end side (left side in FIG. 1) of the main oil hall 21, further diverges into a chain tensioner side path 24 and a VVT (Variable Valve Timing) side path 25.

The oil supplied to the chain tensioner side path 24 is utilized as the hydraulic oil for a chain tensioner 41 to adjust the tension of a timing chain. In contrast, the oil supplied to the VVT side path 25 is utilized as the hydraulic oil for an OCV 42*b* for VVT and a variable valve timing mechanisms 42 and 43 through the oil filter 42*a* for an OCV (Oil Control Valve).

On the other hand, the oil path 23, which is communicated with the other end side (right side in FIG. 1) of the main oil hall 21, further diverges into a lash adjuster side path 26 and a shower pipe side path 27.

The lash adjuster side path 26 further diverges into an intake side path 26*a* and an exhaust side path 26*b*. The intake side path 26*a* is communicated with the oil supply paths of the lash adjusters 44 disposed in accordance with the intake valve of each cylinder, and the oil passing through the oil supply paths is used as the hydraulic oil for the lash adjuster 44. Similarly, the exhaust side path 26*b* is communicated with the oil supply paths of the lash adjusters 45 disposed in accordance with the exhaust valve of each cylinder, and the oil passing through the oil supply paths is used as the hydraulic oil for the lash adjusters 45.

It is noted that the lash adjuster side path, 26 diverges and supplies the oil to the journal portion of each camshaft 16. Accordingly, lubrication is provided between each camshaft 16 and the journal bearing portion of the cylinder head 11 and between each camshaft 16 and the journal bearing portion of a cam cap not illustrated.

The shower pipe side path 27 also diverges into an intake side path 27*a* and an exhaust side path 27*b*. Regarding the intake side path 27*a*, an oil dispersion hole not illustrated in accordance with the cam lobe of the intake camshaft is formed. Accordingly, the oil flowing in the intake side path 27*a* is dispersed from the oil dispersion hole to the contact portion between the cam lobe of the intake camshaft and the roller portion of a rocker arm, which is conductive to the lubrication therebetween. Similarly, regarding the exhaust side path 27*b*, an oil dispersion hole not illustrated in accordance with the cam lobe of the exhaust camshaft is formed. Accordingly, the oil flowing in the exhaust side path 27*b* is dispersed from the oil dispersion hole to the cam lobe of the exhaust camshaft, which is conductive to the lubrication therebetween.

—Oil Jet Apparatus—

The oil supply system 2 includes an oil jet apparatus 5 that cools the pistons 14. Hereinafter, the oil jet apparatus 5 will be described.

Figure 2:
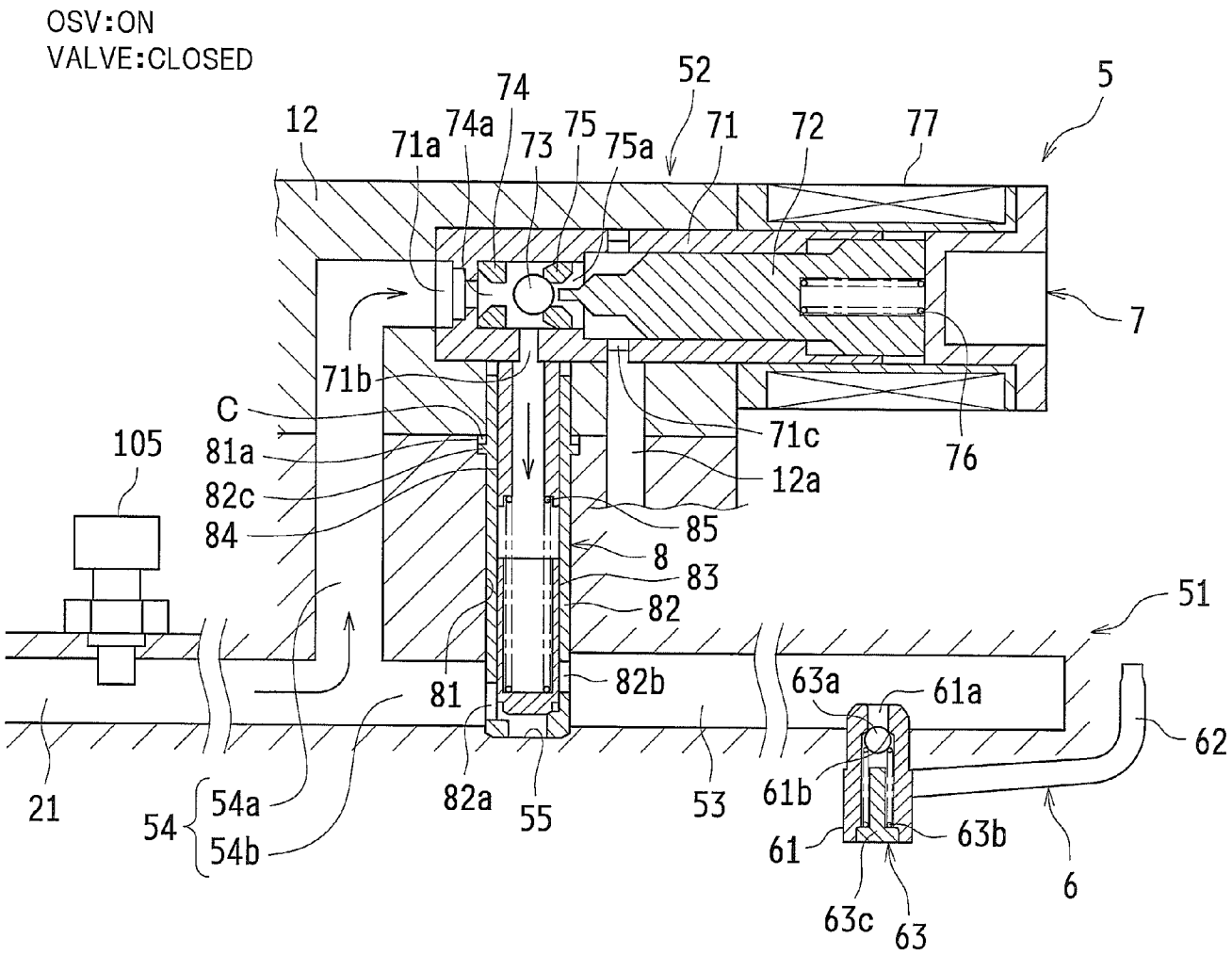
FIG. 2 is a cross-sectional view of an oil jet apparatus and its periphery and the view illustrating the closed state of an oil jet switching valve and a check ball mechanism.

FIG. 2 is a cross-sectional view of the oil jet apparatus 5 and its periphery. FIG. 2 illustrates a state where a later-described oil jet switching valve 8 is closed (see FIG. 3 regarding a state where the oil jet switching valve 8 is opened). It is noted that, for convenience' sake, in FIGS. 2 and 3, a later-described OSV 7 is arranged in the horizontal direction (its axial direction corresponds to the horizontal direction), and a hydraulic pressure sensor 105 is arranged in the vertical direction (its axial direction corresponds to the vertical direction).

As illustrated in FIG. 2, the oil jet apparatus 5 includes an oil jet mechanism 51 and an oil jet switching mechanism 52 provided on the upstream side of the oil jet mechanism 51.

The oil jet mechanism 51 includes a plurality (four in the present embodiment) of piston jet nozzles (oil jet nozzles) 6 disposed in accordance with respective cylinders, and an oil jet gallery (oil path) 53 that supplies the oil flown in from the main oil hall 21 to the piston jet nozzles 6 in a case where the oil jet switching valve 8 of the oil jet switching mechanism 52 is in an open state.

On the other hand, the oil jet switching mechanism 52 includes an oil jet flow path 54 communicated with the main oil hall 21, an OSV (Oil Switching Valve; control valve) 7 connected to the oil jet flow path 54, and the oil jet switching valve 8.

Hereinafter, the specific constitution of the oil jet mechanism 51 and the oil jet switching mechanism 52 will be described.

(Oil Jet Mechanism)

The oil jet gallery 53 is formed in the interior of the cylinder block 12. The upstream end of the oil jet gallery 53 can be communicated with the main oil hall 21 via the oil jet switching mechanism 52. Also, the downstream side of the oil jet gallery 53 diverges in accordance with each cylinder. The piston jet nozzle 6 is disposed in the vicinity of each downstream end of the diverged oil path. Accordingly, in a case where the oil jet switching valve 8 of the oil jet switching mechanism 52 is in an open state (see FIG. 3), the oil is supplied from the main oil hall 21 through the oil jet switching mechanism 52 to the oil jet gallery 53 (the opening/closing operation of the oil jet switching valve 8 in the oil jet switching mechanism 52 will be described later).

The piston jet nozzle 6 includes a main body 61 and a tubular nozzle 62 mounted on the main body 61.

A check ball mechanism (check valve mechanism) 63 is stored in the interior of the main body 61. As the specific constitution of a check ball mechanism 63, a through hole 61*a* that is penetrated in the up-and-down direction is formed in the interior of the main body 61. The upper end opening of the through hole 61*a* is communicated with the oil jet gallery 53. Also, regarding the dimension of the internal diameter of the through hole 61*a*, the upper side portion thereof is formed in a small diameter (hereinafter, referred to as a small-diameter portion), and the lower side portion thereof is formed in a large diameter (hereinafter, referred to as a large-diameter portion). Then, the lower end of the small-diameter portion is provided as a valve seat 61*b*.

A check ball 63*a* that can be in contact with the valve seat 61*b* and a spring 63*b* made up of a compression coil spring that presses the check ball 63*a* against the valve seat 61*b* are stored in the interior of the through hole 61*a*. The dimension of the external diameter of the check ball 63*a* is set larger than the dimension of the internal diameter of the small-diameter portion of the through hole 61*a* and smaller than the dimension of the internal diameter of the large-diameter portion of the through hole 61*a*. Furthermore, a plug 63*c* that blocks the lower end opening of the through hole 61*a* and is in contact with the lower end of the spring 63*b* is installed at the lower end of the main body 61. Accordingly, the spring 63*b* is compressed between the valve seat 61*b* and the plug 63*c*.

On the other hand, the internal space of the nozzle 62 is communicated with the large-diameter portion of the through hole 61*a* of the main body 61. Also, after extending from the main body 61 approximately in the horizontal direction, the nozzle 62 extends upward approximately in the vertical direction, and an injection hole oriented to the rear surface of the piston 14 is formed on the upper end portion of the nozzle 62.

With this constitution, when hydraulic pressure acted on from the oil jet gallery 53 to the upper end opening of the through hole 61*a* is less than predetermined pressure, the check ball 63*a* is in contact with the valve seat 61*b* by means of the energized force of the spring 63*b*. Accordingly, the through hole 61*a* is closed (closed state of the check ball mechanism 63; see FIG. 2). In this case, the oil jet from the injection hole of the nozzle 62 is not executed.

On the other hand, when the hydraulic pressure acted on from the oil jet gallery 53 to the upper end opening of the through hole 61*a* is equal to or higher than the predetermined pressure, the check ball 63*a* is separated from the valve seat 61*b* against the energized force of the spring 63*b*. Accordingly, the through hole 61*a* is opened (open state of the check ball mechanism 63; see FIG. 3). In this case, the oil, which is flown from the oil jet gallery 53 in the through hole 61*a*, flows into the nozzle 62. Accordingly, the oil flown in the nozzle 62 is injected to the rear surface of the piston 14. The piston 14 is cooled by the oil jet, and for example, the excessive increase in an in-cylinder temperature is suppressed, thereby preventing the occurrence of knocking. It is noted that the value of hydraulic pressure, at which the check ball mechanism 63 is opened, is adjusted by appropriately setting the spring constant of the spring 63*b*.

(Oil Jet Switching Mechanism)

The oil jet flow path 54 of the oil jet switching mechanism 52 is formed in the interior of the cylinder block 12, and the upstream end of the oil jet flow path 54 is communicated with the main oil hall 21. Also, the oil jet flow path 54, near the downstream end thereof, diverges into a pilot flow path 54*a* which at the downstream end thereof is connected with the OSV 7 and an oil jet guiding oil path 54*b* disposed on the approximately same axis as that of the oil jet gallery 53.

The oil jet switching valve 8 is stored in a valve insertion hole 81 formed in the interior of the cylinder block 12. The valve insertion hole 81 extends in the direction approximately orthogonal to the extending direction of the oil jet gallery 53 and the oil jet guiding oil path 54*b*, and one end side (upper end side in the diagram) of the valve insertion hole 81 is communicated with the internal space of the OSV 7, and the other end side (lower end side in the diagram) of the valve insertion hole 81 is communicated with the oil jet gallery 53 and the oil jet guiding oil path 54*b*.

Figure 4:
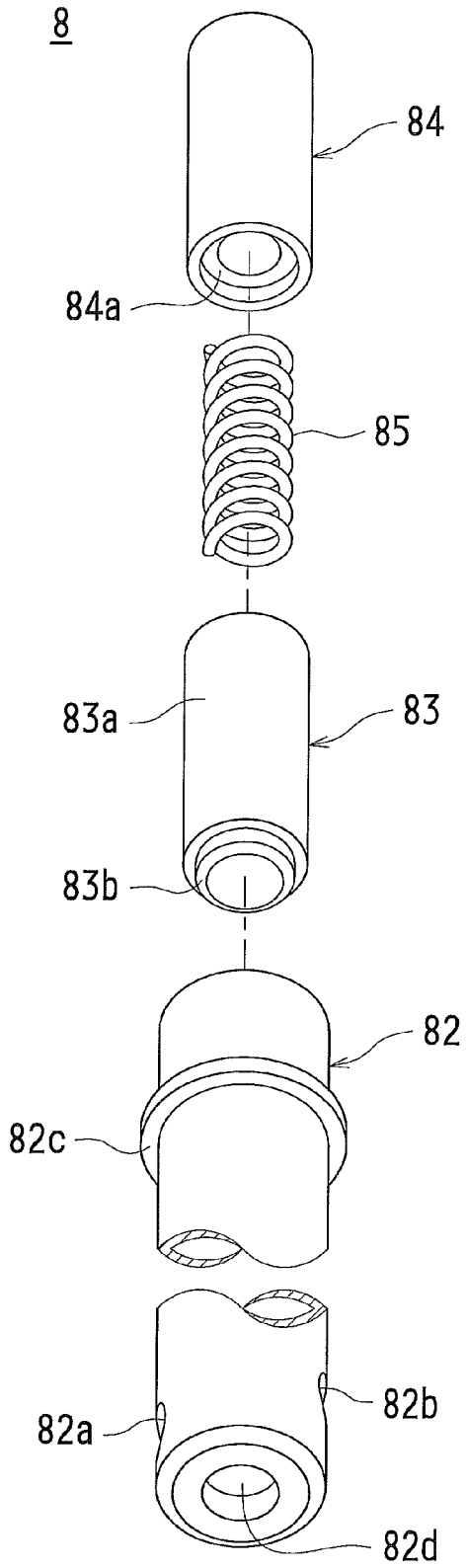
FIG. 4 is an exploded perspective view of the oil jet switching valve.

As illustrated in FIG. 4 (the exploded perspective view of the oil jet switching valve 8), the oil jet switching valve 8 stored in the valve insertion hole 81 includes a valve housing 82, a main valve body 83, a collar 84, and a spring (energized means) 85. Hereinafter, respective portions will be described.

<Valve Housing>

The valve housing 82 is a member that has an approximately cylindrical shape and is inserted into the valve insertion hole 81. The dimension of the external diameter of the valve housing 82 approximately corresponds to the dimension of the internal diameter of the valve insertion hole 81. Accordingly, the valve housing 82 is freely movable in the direction (up-and-down direction in FIG. 2) along with the axis thereof in the interior of the valve insertion hole 81. Also, the length dimension of the valve housing 82 (the length dimension in the direction along the shaft center) is set slightly shorter than the sum of the length dimension of the valve insertion hole 81 (the length dimension in the direction along the shaft center) and the dimension of the internal diameter of the oil jet guiding oil path 54*b*.

Also, an oil guiding inlet 82*a* and an oil guiding outlet (opening) 82*b*, between which the shaft center of the valve housing 82 is sandwiched, are formed opposite to each other on the lateral side in the vicinity of tip end portion of the valve housing 82. The oil guiding inlet 82*a* is opened to the oil jet guiding oil path 54*b*. Also, the shaft center of the oil guiding inlet 82*a* is orthogonal to the shaft center of the valve housing 82. In contrast, the oil guiding outlet 82*b* is opened to the oil jet gallery 53. Also, the shaft center of the oil guiding outlet 82*b* is orthogonal to the shaft center of the valve housing 82. Also, the opening area of the oil guiding outlet 82*b* is set slightly smaller than the opening area of the oil guiding inlet 82*a*. Also, the shaft center of the oil guiding outlet 82*b* is positioned slightly on the upper side with respect to the shaft center of the oil guiding inlet 82*a* (see FIG. 7A).

Also, an annular concave portion 81*a* is formed at a position in the vicinity of the upper end in the diagram on the inner surface of the valve insertion hole 81. The formation position, height dimensions, and external diameter dimensions of the concave portion 81*a* are appropriately set.

On the other hand, an annular protrusion 82*c* inserted into the concave portion 81*a* is formed on the outer circumferential surface of the valve housing 82. The thickness dimensions of the protrusion 82*c* (dimension in the up-and-down direction in FIG. 2) is slightly shorter than the height dimension of the concave portion 81*a* (dimension in the up-and-down direction in the diagram). That is, a clearance C is provided between the protrusion 82*c* and the concave portion 81*a* in the up-and-down direction in the diagram. Accordingly, the valve housing 82 is freely movable only by the dimension of the clearance C in the direction along the shaft center (the up-and-down direction in the diagram) in the interior of the valve insertion hole 81.

Also, a recessed portion 55 whose shape approximately matches the shape of the tip end portion (lower end portion) of the valve housing 82 is formed on the bottom portion (inner wall surface) of the oil path in the boundary portion between the oil jet guiding oil path 54*b* and the oil jet gallery 53. The recessed portion 55 is formed approximately in a cylindrical shape. The dimension of the internal diameter of the recessed portion 55 is set in such a manner as to approximately correspond to the dimension of the external diameter of the tip end portion of the valve housing 82 or be slightly larger than the dimension of the external diameter of the tip end portion of the valve housing 82. Accordingly, when the valve housing 82, which is freely movable in the up-and-down direction as described above, is transferred to the lower side, the tip end portion of the valve housing 82 is configured to fit into the recessed portion 55. Also, in a state where the tip end portion of the valve housing 82 fits into the recessed portion 55, it is configured that the lower surface of the protrusion 82*c* of the valve housing 82 is in contact with the bottom surface of the concave portion 81*a* of the valve insertion hole 81, or that a slight gap exists therebetween. That is, when the valve housing 82 is transferred to the lower side, the protrusion 82*c* and the concave portion 81*a* are formed in such a manner as to include the clearance C that allows the valve housing 82 to transfer to a position at which the tip end portion of the valve housing 82 fits into the recessed portion 55.

Figure 7A:
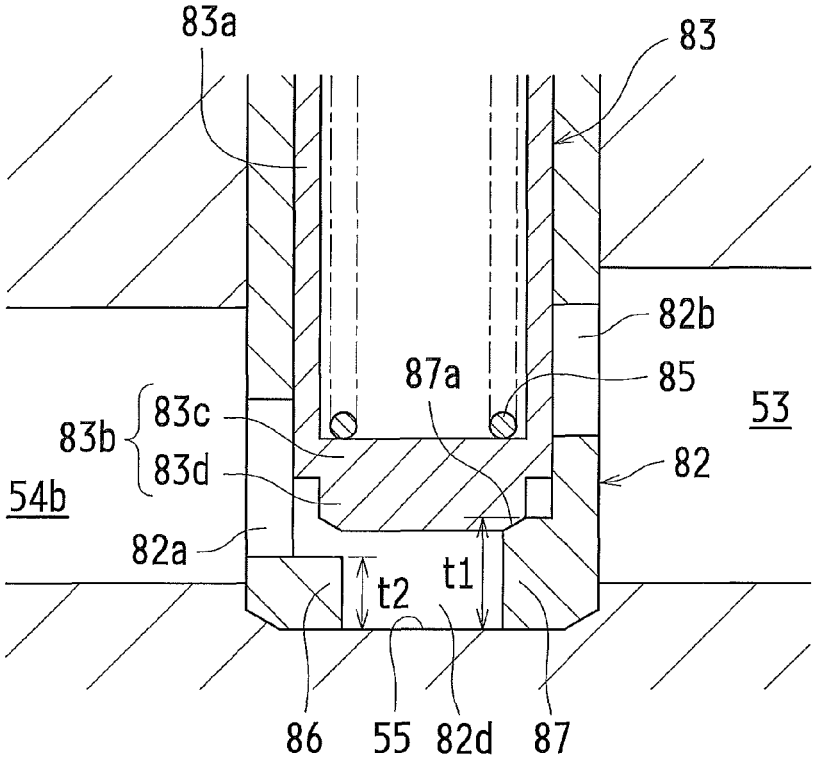
FIG. 7A is an enlarged cross-sectional view of the tip end portion of the oil jet switching valve according to the present embodiment and the view illustrating the closed state of the oil jet switching valve.
Figure 7B:
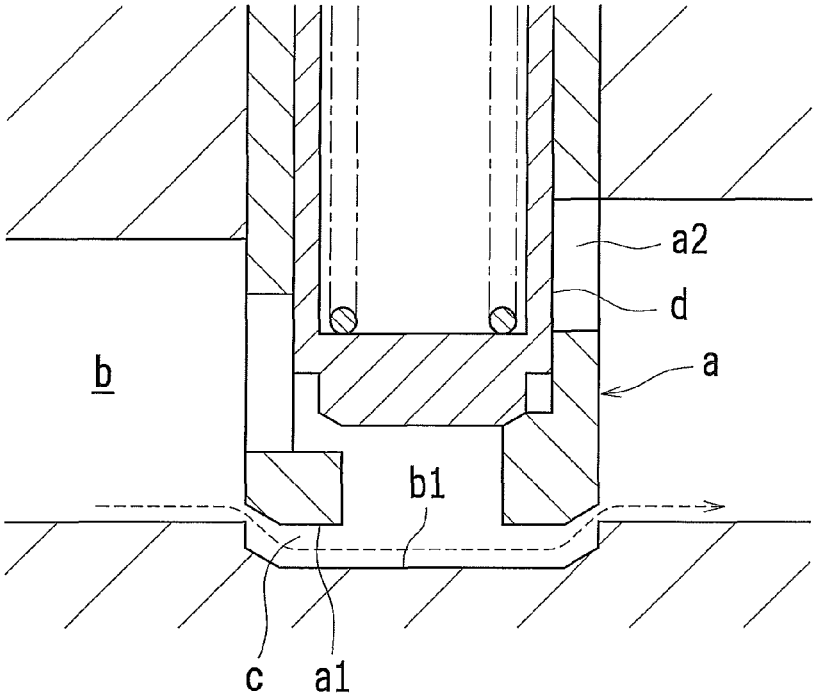
FIG. 7B is an enlarged cross-sectional view of the tip end portion of the oil jet switching valve in a comparative example and the view illustrating the closed state of the oil jet switching valve.

Furthermore, as illustrated in FIG. 7A, an opening 82*d* is formed at the tip end portion of the valve housing 82. Protrusions 86 and 87 that protrude to the inner circumferential side are provided on the inner circumferential edge of the opening 82*d*. The height dimension (t1 in the diagram) of the protrusion 87 provided on the side of the oil guiding outlet 82*b* is set slightly longer than the height dimension (t2 in the diagram) of the protrusion 86 provided on the side of the oil guiding inlet 82*a*. Also, an inclined surface 87*a* is formed on the upper end portion of the inner edge of the protrusion 87 provided on the side of the oil guiding outlet 82*b*. In a later-described closed state of the main valve body 83, the tip end portion of the main valve body 83 is in contact with the inclined surface 87*a*. It is noted that the formation of the protrusion 87 on the side of the oil guiding outlet 82*b* is set in a range of approximately one third to one fourth of the entire circumference of the valve housing 82. The range is not limited to this. As described later, the range may be provided such that an area (the area of the inclined surface 87*a*), on which the energized force of the spring 85 is steadily transmitted to the valve housing 82 via the main valve body 83, is secured.

<Main Valve Body>

The main valve body 83 is a member inserted into the interior of the valve housing 82, and, as illustrated in FIG. 7A, formed in a bottomed cylindrical shape and includes a cylindrical torso portion 83*a* and a valve portion 83*b* integrally formed with the lower end of the torso portion 83*a*. The dimension of the external diameter of the torso portion 83*a* approximately corresponds to the dimension of the internal diameter of the valve housing 82. Accordingly, the main valve body 83 is freely movable in the interior of the valve housing 82 in the direction along the shaft center thereof (the up-and-down direction in the diagram). Also, as the constitution of the valve portion 83*b*, the valve portion 83*b* includes a base portion 83*c*, whose dimension of the external diameter corresponds to the dimension of the external diameter of the torso portion 83*a*, and a tip end portion 83*d*, which is contiguously disposed on the lower end of the base portion 83*c*, that has a diameter smaller than that of the base portion 83*c*. Also the dimension of the external diameter of the tip end portion 83*d* is larger than the dimension of the internal diameter of the opening 82*d* formed in the tip end portion of the valve housing 82. Then, as described above, in the closed state of the main valve body 83, it is constituted that the tip end portion 83*d* of the valve portion 83*b* is in contact with the inclined surface 87*a* of the protrusion 87 provided on the side of the oil guiding outlet 82*b* of the valve housing 82. Also, in a state where the tip end portion 83*d* of the valve portion 83*b* is in contact with the inclined surface 87*a*, a gap is made between the tip end portion 83*d* of the valve portion 83*b* and the protrusion 86 provided on the side of the oil guiding inlet 82*a*. Accordingly, it is constituted that the hydraulic pressure of the main oil hall 21 and the oil jet guiding oil path 54*b* acts on the tip end portion 83*d* of the valve portion 83*b*. This hydraulic pressure acts in the vertical direction with respect to the tip end portion 83*d* of the valve portion 83*b*, which functions as a force with which the main valve body 83 is transferred backward (transferred upward in the diagram).

<Collar>

The collar 84 is a cylindrical member inserted into the interior of the valve housing 82. The dimension of the external diameter of the collar 84 approximately corresponds to the dimension of the internal diameter of the valve housing 82. Also, a spring seat 84*a* that is in contact with the upper end edge of the spring 85 is formed in the lower end portion of the collar 84. The upper end surface of the collar 84 is in contact with the casing 71 of the OSV 7.

<Spring>

The spring 85 is made up of a compression coil spring and stored in a compressed state between the upper surface of the valve portion 83*b* of the main valve body 83 and the spring seat 84*a* of the collar 84. Accordingly, an energized force oriented downward in the diagram is applied to the main valve body 83. That is, the energized force, which is oriented in such a manner as to cause the main valve body 83 to move forward to the boundary portion between the oil jet guiding oil path 54*b* and the oil jet gallery 53, is applied. Accordingly, when the back pressure of the main valve body 83 and the internal pressure (hydraulic pressure acted on the tip end portion 83*d* of the valve portion 83*b*) of the oil jet guiding oil path 54*b* approximately become equal, the main valve body 83 is transferred forward by the energized force of the spring 85 to the side of the oil jet guiding oil path 54*b*, thereby closing the oil guiding outlet 82*b* of the valve housing 82. Consequently, this cuts off space between the oil jet guiding oil path 54*b* and the oil jet gallery 53 (the closed state of the oil jet switching valve 8; see a state of FIG. 2). In contrast, when the internal pressure (the hydraulic pressure acted on the tip end portion 83*d* of the valve portion 83*b*) of the oil jet guiding oil path 54*b* becomes higher than the sum of the back pressure of the main valve body 83 and the energized force of the spring 85, the main valve body 83 transfers against the energized force of the spring 85 in the direction that the main valve body 83 moves backward from the oil jet guiding oil path 54*b* (is drawn in the interior of the valve insertion hole 81), thereby opening the oil guiding outlet 82*b* of the valve housing 82. Accordingly, the oil jet guiding oil path 54*b* and the oil jet gallery 53 are communicated to each other therebetween (the opened state of the oil jet switching valve 8; see a state of FIG. 3).

<OSV>

Regarding the OSV 7, a plunger 72 is stored in the casing 71 in a reciprocating movable manner. The OSV 7 switches the flow paths of the oil by the reciprocating movement of the plunger 72 in response to the electric conduction and non-electric conduction of an electromagnetic solenoid 77.

Specifically, a hydraulic pressure guiding port (first port) 71*a*, a valve pressure port (second port) 71*b*, and a drain port 71*c* are formed in the casing 71. The hydraulic pressure guiding port 71*a* is provided on the tip end surface of the casing 71 and communicated with the pilot flow path 54*a*. The valve pressure port 71*b* is provided on the lateral surface of the casing 71 (the lower surface in FIG. 2) and communicated with the valve insertion hole 81 (the back pressure space of the main valve body 83). The drain port 71*c* is provided on the lateral surface of the casing 71 on the base end side (the side of the electromagnetic solenoid 77) with respect to the formation position of valve pressure port 71*b* and communicated with a drain oil path 12*a* connected to a crankcase not illustrated.

Also, check ball 73 is stored in positions in accordance with the hydraulic pressure guiding port 71*a* and the valve pressure port 71*b* in the casing 71. Depending on its position, the check ball 73 is movably transferred between a valve closed position (see the state in FIG. 2) where the hydraulic pressure guiding port 71*a* and the valve pressure port 71*b* are communicated, and the hydraulic pressure guiding port 71*a* and the valve pressure port 71*b* are blocked from the drain port 71*c* and a valve opened position (see the state in FIG. 3) where the valve pressure port 71*b* and the drain port 71*c* are communicated, and the valve pressure port 71*b* and the drain port 71*c* are blocked from the hydraulic pressure guiding port 71*a*.

Figure 3:
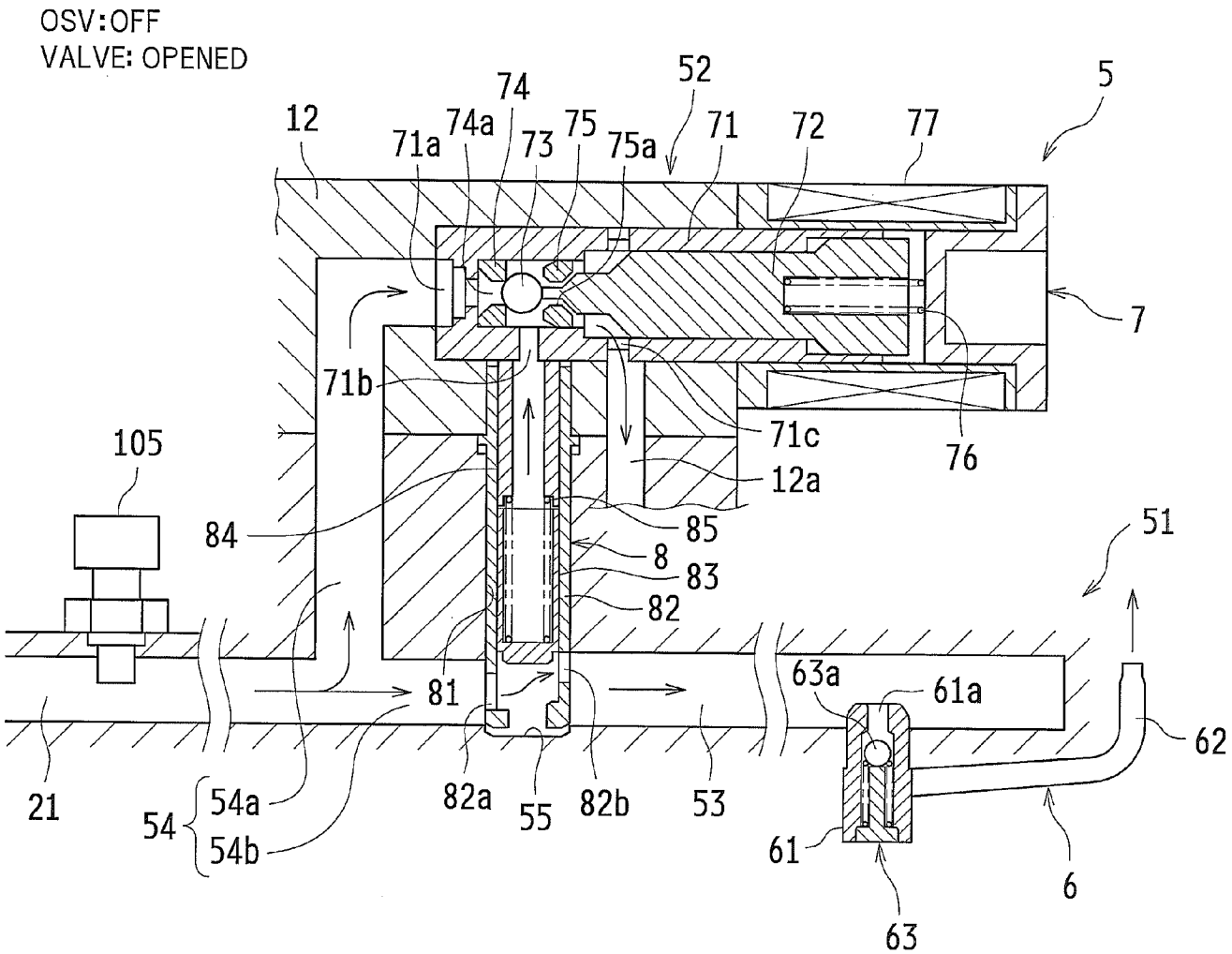
FIG. 3 is a cross-sectional view of the oil jet apparatus and its periphery and the view illustrating the opened state of the oil jet switching valve and the check ball mechanism.

Specifically, a stopper 74 is fixed on the side of the hydraulic pressure guiding port 71*a* with respect to the position of the check ball 73 stored. The stopper 74 includes a hydraulic pressure guiding hole 74*a* with which the hydraulic pressure guiding port 71*a* and the interior (the storage space of the check ball 73) of the casing 71 are communicated. The dimension of the internal diameter of the hydraulic pressure guiding hole 74*a* is set smaller than the dimension of the external diameter of the check ball 73. Accordingly, when the check ball 73 is at a position where the check ball 73 moves backward from the stopper 74, as illustrated in FIG. 2, the hydraulic pressure guiding hole 74*a* is opened, and the hydraulic pressure guiding port 71*a* and the valve pressure port 71*b* are communicated. In contrast, when the check ball 73 is transferred to the stopper 74 and is in contact with the stopper 74, as illustrated in FIG. 3, the hydraulic pressure guiding hole 74*a* is closed, and the hydraulic pressure guiding port 71*a* and the valve pressure port 71*b* are blocked.

Also, a valve sheet 75 is fixed on the side of the drain port 71*c* with respect to the storage position of the check ball 73. The valve sheet 75 includes a drain hole 75*a* with which the drain port 71*c* and the interior (the storage space of the check ball 73) of the casing 71 are communicated. The dimension of internal diameter of the drain hole 75*a* is set smaller than the dimension of the external diameter of the check ball 73. Accordingly, when the check ball 73 is at a position where the check ball 73 moves backward from the valve sheet 75, as illustrated in FIG. 3, the drain hole 75*a* is opened, and the valve pressure port 71*b* and the drain port 71*c* are communicated. In contrast, when the check ball 73 is transferred to the valve sheet 75 and is in contact with the valve sheet 75, as illustrated in FIG. 2, the drain hole 75*a* is closed, and the valve pressure port 71*b* and the drain port 71*c* are blocked.

Also, an energized force oriented to the side of the check ball 73 is applied to the plunger 72 by means of the spring 76 made up of the compression coil spring, and the plunger 72 is driven by the electromagnetic solenoid 77. That is, when a voltage is not applied to the electromagnetic solenoid 77, as illustrated in FIG. 3, the plunger 72 is transferred forward by the energized force of the spring 76 to the left side of the diagram in the casing 71. This state represents the OFF state of the OSV 7. In contrast, when a voltage is applied to the electromagnetic solenoid 77, as illustrated in FIG. 2, the plunger 72 is transferred backward against the energized force of the spring 76 to the right side of the diagram in the casing 71. This state represents the ON state of the OSV 7. The application and non-application of the voltage to the electromagnetic solenoid 77 is controlled by an ECU 100 (see FIG. 5).

In the ON state of the OSV 7, as illustrated in FIG. 2, the plunger 72 does not press the check ball 73. The check ball 73 receives the hydraulic pressure from the pilot flow path 54*a*, which causes the check ball 73 to move backward from the stopper 74 and be positioned in such a manner as to be in contact with the valve sheet 75. Accordingly, the hydraulic pressure guiding port 71*a* and the valve pressure port 71*b* are communicated. Consequently, the hydraulic pressure passing from the main oil hall 21 through the pilot flow path 54*a* is guided to the valve insertion hole 81. In this case, the hydraulic pressure from the main oil hall 21 acts on the tip end surface and the back surface of the main valve body 83 of the oil jet switching valve 8, so that the main valve body 83 is transferred to the side of the oil jet guiding oil path 54*b* by the energized force of the spring 85 provided on the back surface side thereof (transferred to the lower side in the diagram). Following the transfer of the main valve body 83, the main valve body 83 closes the oil guiding outlet 82*b* of the valve housing 82, and the outer edge portion of the tip end portion 83*d* of the main valve body 83 is in contact with the inclined surface 87*a* of the protrusion 87 on the side of the oil guiding outlet 82*b* of the valve housing 82. With this contact, the valve housing 82 also receives the energized force of the spring 85, and the valve housing 82 transfers forward to the recessed portion 55, and as illustrated in FIG. 7A, the tip end portion of the valve housing 82 fits into the recessed portion 55. Accordingly, the downstream end of the oil jet guiding oil path 54*b* is in a state of being closed by the oil jet switching valve 8, and the oil is not supplied to the oil jet gallery 53 of the oil jet mechanism 51, and the oil jet is stopped.

On the other hand, when the OSV 7 is in the OFF state, as illustrated in FIG. 3, the plunger 72 receives the energized force of the spring 76, transfers forward, and presses the check ball 73. Accordingly, the check ball 73 moves backward from the valve sheet 75 and stays at a position where the check ball 73 is in contact with stopper 74. Accordingly, the valve pressure port 71*b* and the drain port 71*c* are communicated. Consequently, the oil in the valve insertion hole 81 is drained from the valve pressure port 71*b* and the drain port 71*c* through the drain oil path 12*a* into the crankcase. This causes the hydraulic pressure in the valve insertion hole 81 to descend rapidly. Also, the hydraulic pressure from the main oil hall 21 acts on the tip end surface of the main valve body 83 of the oil jet switching valve 8, so that the oil jet switching valve 8 is transferred to the interior of the valve insertion hole 81 against the energized force of the spring 85 provided on the back surface side thereof (transferred to the upper side in the diagram). Following the transfer of the main valve body 83, the main valve body 83 opens the oil guiding outlet 82*b* of the valve housing 82, and the oil jet guiding oil path 54*b* and the oil jet gallery 53 are communicated, and the oil is supplied to the oil jet gallery 53 of the oil jet mechanism 51. Then, when the hydraulic pressure of the oil supplied to the oil jet gallery 53 reaches a predetermined value in response to the increase in the engine rotation speed, the check ball mechanism 63 of the piston jet nozzle 6 is opened, and the oil jet is executed, and the piston 14 is cooled.

Thus, in the oil jet switching mechanism 52, the hydraulic pressure in the interior of the valve insertion hole 81 is switched in conjunction with the switching operation of the OSV 7, and the opening/closing of the oil jet switching valve 8 is carried out. Accordingly, the OSV 7 only needs to include a switching function of the oil supply paths, which makes it possible to provide a relatively small-size OSV 7. Consequently, this achieves the miniaturization of the oil jet switching mechanism 52. Also, when the oil jet switching valve 8 is transferred backward, the hydraulic pressure of the valve insertion hole 81 is descended. Accordingly, the backward transfer of the oil jet switching valve 8 is started approximately concurrently with the switching of the OSV 7, which is favorable in terms of controllability.

The cooling of the pistons 14 is mainly aimed at preventing the occurrence of knocking in the combustion stroke of the engine 1. Accordingly, basically, a demand for cooling the pistons 14 is low during warm-up of the engine 1, while the demand for cooling the pistons 14 becomes high after the completion of the warm-up of the engine 1 (in particular, in a high-load operation area or a high rotation area after the completion of the warm-up). Accordingly, for example, at the initial time of the start-up of cooling the engine 1, the temperature of a coolant is relatively low, so that the demand for cooling the pistons 14 is low, and the OSV 7 is brought into the ON state, and the oil jet is stopped. Also, in a predetermined operation area (the high-load operation area or the high rotation area) after the completion of the warm-up of the engine 1, the OSV 7 is brought into the OFF state, and the engine oil is supplied to the oil jet gallery 53, and the engine oil is injected from respective piston jet nozzles 6 to the back surface side of the pistons 14.

—System Control of OSV—

Figure 5:
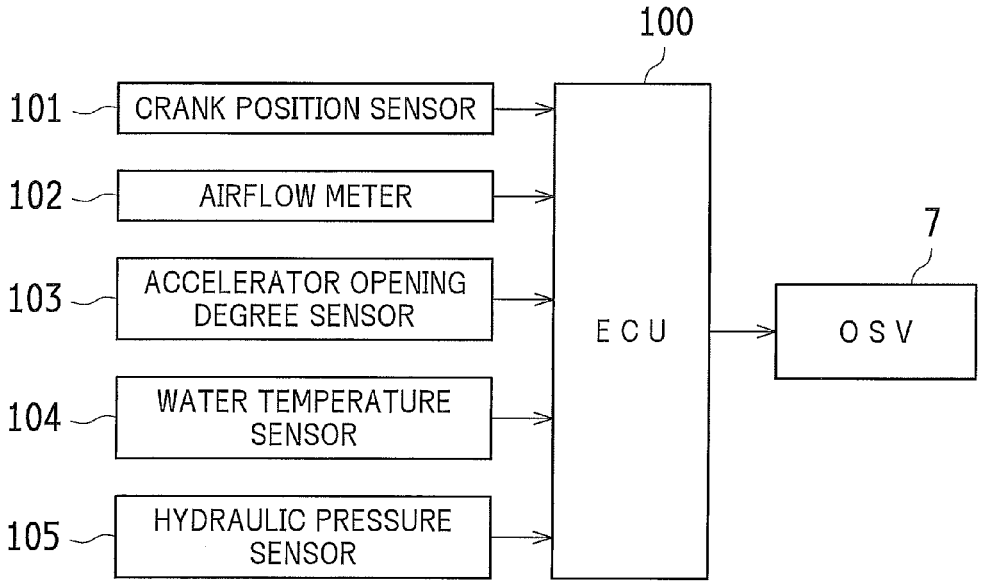
FIG. 5 is a block diagram illustrating a control system of an OSV.

FIG. 5 is a block diagram illustrating a control system according to the OSV 7. An ECU 100 is an electronic control unit that executes the driving control of the engine 1 and the like. The ECU 100 includes a CPU (Central Processing Unit), a ROM (Read Only Memory), a RAM (Random Access Memory), a backup RAM, and the like.

The ROM stores various control programs, maps that are referred to when executing those various control programs, and the like. The CPU executes various arithmetic processes based on the various control programs and maps stored in the ROM. The RAM is a memory that temporarily stores results of arithmetic operations with the CPU or data input from the sensors, and the like. Also, the backup RAM is a nonvolatile memory that stores data that needs storing or the like when the engine 1 is stopped.

In the control system according to the OSV 7, a plurality of sensors are connected to the ECU 100. Specifically, the ECU 100 is connected to a crank position sensor 101 that outputs a pulse signal every time the crankshaft 15, which is the output shaft of the engine 1, rotates by a predetermined angle, an airflow meter 102 that detects an intake air amount, an accelerator opening degree sensor 103 that detects an accelerator opening degree, which is the amount of pressing of an accelerator pedal, a water temperature sensor 104 that detects the temperature of the engine coolant, a hydraulic pressure sensor 105 that detects the hydraulic pressure in the interior of the main oil hall 21, and the like. Signals from these sensors 101 to 105 are inputted to the ECU 100. As illustrated in FIGS. 1 and 2, the hydraulic pressure sensor 105 is installed in the main oil hall 21 and detects the hydraulic pressure in the interior of the main oil hall 21.

It is noted that, besides the above-mentioned sensors, the ECU 100 is connected to an oil temperature sensor, a throttle opening degree sensor, a wheel speed sensor, a shift position sensor, a brake pedal sensor, an intake air temperature sensor, an A/F sensor, an $O_2$ sensor, a cam position sensor, and the like (any of which is not illustrated) as the known sensors, and signals form these sensors are inputted to the ECU 100.

Then, besides the control of various actuators (a throttle motor, an injector, an ignitor, and the like) of the engine 1, the ECU 100 performs the control (oil jet control) of the opening/closing of the OSV 7 based on the output signals of various sensors.

Then, regarding the switching control of the oil jet by means of the oil jet apparatus 5, during a period in which a predetermined oil jet stop condition is established, the OSV 7 is brought into ON, and the oil jet is stopped. The condition of the stoppage of the oil jet is established, for example, in a case where the engine rotation speed is equal to or less than a predetermined speed, and the engine load is equal to or less than a predetermined value.

Figure 6:
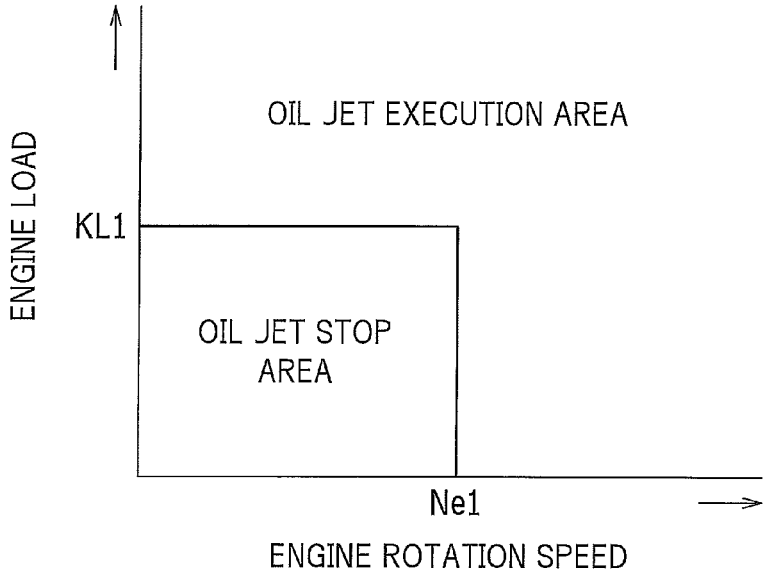
FIG. 6 is a view illustrating an oil jet execution map in which an engine rotation speed and an engine load are provided as parameters.

FIG. 6 illustrates an oil jet execution map stored in the ROM of the ECU 100. In the oil jet execution map, an oil jet execution area and an oil jet stop area are set, wherein the engine rotation speed and the engine load are provided as parameters. That is, when the engine rotation speed is equal to or less than Ne1 in the diagram, and the engine load is equal to or less than KL1 in the diagram, it is assumed that the engine operation area is positioned in the oil jet stop area, and an oil jet stop signal is outputted from the ECU 100, and the OSV 7 is brought into ON, and the oil jet is stopped. In contrast, when the engine rotation speed exceeds Ne1 in the diagram, or when the engine load exceeds KL1 in the diagram, it is assumed that the engine operation area is positioned in the oil jet execution area, and an oil jet execution signal is outputted from the ECU 100, and the OSV 7 is brought into OFF, and the oil jet is executed.

It is noted that the values of the engine rotation speed Ne1 and the engine load KL1 are set by experiment or simulation. For example, each value is set in such a manner as to fall within a range in which the knocking does not occur during the combustion stroke of the engine 1 and appropriately maintain the temperature of the pistons 14 (in such a manner as not to excessively cool the pistons 14).

Then, when the predetermined oil jet stop condition is established, and the oil jet stop signal is outputted from the ECU 100, as described above, the OSV 7 is brought into ON, as illustrated in FIG. 7A, the main valve body 83 is transferred by the energized force of the spring 85 to the side of the oil jet guiding oil path 54*b* (transferred to the lower side in the diagram). Following the transfer of the main valve body 83, the main valve body 83 closes the oil guiding outlet 82*b* of the valve housing 82, and the outer edge portion of the tip end portion 83*d* of the main valve body 83 is in contact with the inclined surface 87*a* of the protrusion 87 on the side of the oil guiding outlet 82*b* of the valve housing 82. With this contact, the valve housing 82 also receives the energized force of the spring 85, and the valve housing 82 transfers forward to the recessed portion 55, and the tip end portion of the valve housing 82 is pressed to the bottom surface of the recessed portion 55. Accordingly, this favorably secures sealability between the tip end surface of the valve housing 82 and the bottom surface of the recessed portion 55, thereby preventing the oil from leaking from a gap between the tip end surface of the valve housing 82 and the bottom surface of the recessed portion 55 to the side of the piston jet nozzle 6.

Thus, in the closed state of the oil jet switching valve 8, the oil leakage to the side of the piston jet nozzle 6 can be prevented, and the reduction of the consumption of the oil can be achieved. Also, the wasteful use of the oil jet from the piston jet nozzles 6 is prohibited, so that the fuel attenuation caused by the oil can be suppressed, and the unnecessary excessive cooling of the pistons 14 can be suppressed, thereby achieving the reduction of PN (Particle Number; smoke).

Also, in the present embodiment, it is constituted that, when the main valve body 83 is transferred forward, the energized force of the spring 85 is applied to the valve housing 82 via the main valve body 83. Accordingly, it is possible to set the period during which the energized force is applied to the valve housing 82 only to a period during which the application of the energized force is required, and when the oil jet switching valve 8 is closed, it is possible to steadily press the tip end portion of the valve housing 82 to the bottom surface of the recessed portion 55.

Furthermore, the valve housing 82 is freely movable only by the clearance C (clearance C between the protrusion 82*c* and the concave portion 81*a*) in the direction along the shaft center, not only the prevention of the coming-off of the valve housing 82 can be achieved, but also the transfer range of the valve housing 82 can be limited. Consequently, it can be avoided that the valve housing 82 is transferred more than necessary, and that the flow of the oil is impeded in the oil paths.

—Modification—

Next, a modification will be described. In the modification, the constitution of the valve housing 82 is different from that of the above-mentioned embodiment. The other constitution and operation are similar to those of the above-mentioned embodiment. Accordingly, only the constitution of the valve housing 82 will be described hereinafter.

Figure 8:
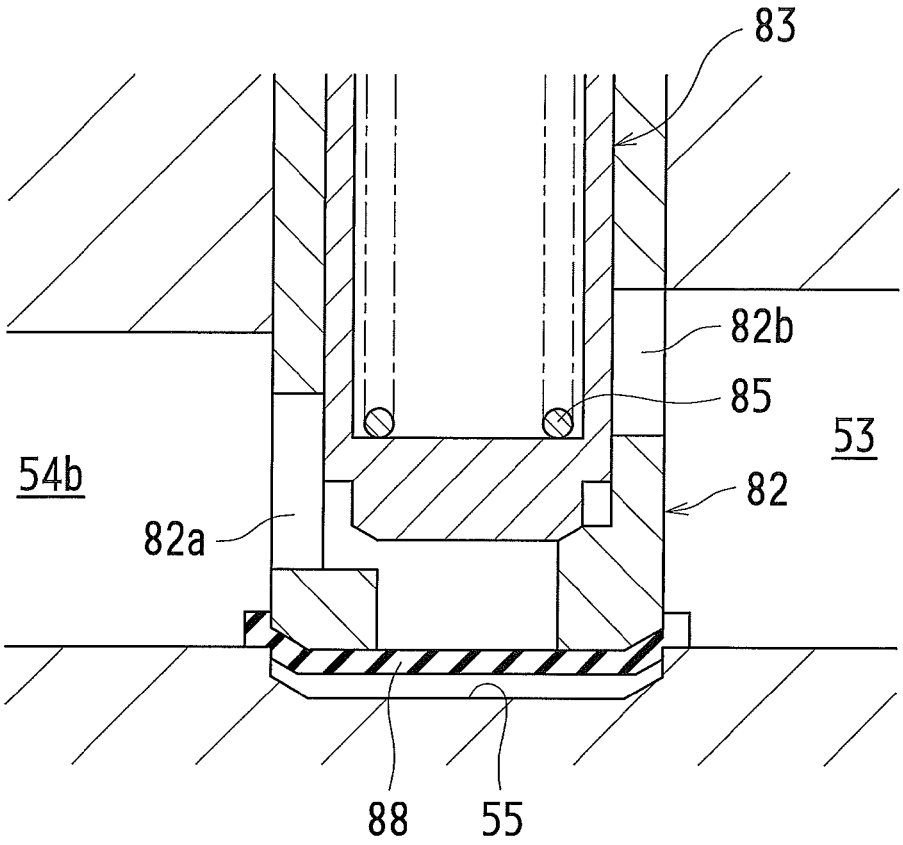
FIG. 8 is an enlarged cross-sectional view of the tip end portion of the oil jet switching valve in a modification.

As illustrated in FIG. 8, regarding the oil jet switching valve 8 according to the modification, it is constituted that a seal member 88 is mounted on the tip end surface of the valve housing 82. The seal member 88 is mounted by a means such as an adhesive from the tip end surface of the valve housing 82 to the lateral surface of the tip end portion of the valve housing 82. It is noted that the seal member 88 is made of rubber or resin, and its material is specifically not limited as long as the member has elasticity.

In this manner, in a state where the seal member 88 is mounted, and the valve housing 82 receives the energized force of the spring 85 and transfers downward, the seal member 88 is interposed between the tip end surface of the valve housing 82 and the recessed portion 55. Consequently, a gap between the tip end surface of the valve housing 82 and the recessed portion 55 is steadily sealed, thereby preventing the oil leakage on the side of the piston jet nozzle 6.

—Other Embodiment—

As described above, the embodiment and the modification of the present invention have been described in detail referring to the drawings, but these are merely one embodiment, and the present invention can be carried out in a mode in which various modifications and improvements are added based on the knowledge of the persons skilled in the art.

Also, in the embodiment and the modification, the case has been described where the present invention is applied to the inline four-cylinder gasoline engine. Regarding the present invention, the number of cylinders and types of engines (V-type, horizontally opposed type, and the like) are specifically not limited. Also, the present invention can be applied to the diesel engine.

Also, in the embodiment and the modification, the OSV 7 is provided in the oil jet switching mechanism 52. The present invention is not limited to this, but an OCV (Oil Control Valve) that can adjust opening degrees may be provided.

Also, in the embodiment and the modification, the case has been described wherein the present invention is applied to a conventional vehicle (a vehicle in which only the engine 1 is mounted as a drive power source), but the present invention can be applied to a hybrid vehicle (a vehicle in which an engine and an electric motor are mounted as the drive power source).

Also, in the embodiment and the modification, the case has been described wherein the present invention is applied to the oil jet apparatus 5 that cools the pistons 14, but the present invention can be applied to an oil jet apparatus that cools the inner wall surface of the cylinders.

Also, in the embodiment, the oil jet apparatus 5 has been exemplified and described as an instrument that switches the supply and non-supply of the engine oil. The present invention is not limited to this, but can be applied to one that switches the supply and non-supply of the engine oil with respect to a cam shower or a timing chain jet. That is, the present invention is applicable in a case where the supply and non-supply of the engine oil for the shower pipe side path 27 are switched, or a case where the supply and non-supply of the engine oil for the timing chain jet not illustrated are switched. In a condition in which the engine rotation speed is equal to or less than a predetermined rotation speed, and the lubrication cannot be carried out by the dispersion of the engine oil, these instruments turn off the OSV and open the oil jet switching valve, thereby supplying the engine oil.

Alternatively, although not illustrated, the present invention can be carried out with additional, various modifications without departing from the scope of the gist of the present invention.

The application claims a priority based on the Japanese Patent Application No. 2012-285945 filed on Dec. 27, 2012, the disclosure of which is herein incorporated by reference in its entirety.

INDUSTRIAL APPLICABILITY

The present invention can be applied to a seal structure of a mechanism that switches the execution and stoppage of an oil jet with respect to an oil jet apparatus.

REFERENCE SIGNS LIST

1 Engine (Internal combustion engine)
21 Main oil hall (Main oil path)
32 Oil pump
5 Oil jet apparatus
51 Oil jet mechanism
53 Oil jet gallery (Oil path)
54*b* Oil jet guiding oil path (Oil path)
55 Recessed portion
6 Piston jet nozzle (Oil jet nozzle)
7 OSV (Control valve)
71*a* Hydraulic pressure guiding port (First port)
71*b* Valve pressure port (Second port)
71*c* Drain port
8 Oil jet switching valve
81 Valve insertion hole (Back pressure space)
81*a* Concave portion
82 Valve housing
82*a* Oil guiding inlet
82*b* Oil guiding outlet (Opening)
82*c* Protrusion
83 Main valve body
83*d* Tip end portion
85 Spring (Energizing means)
87 Protrusion
87*a* Tapered portion
C Clearance

The invention claimed is:

1. An oil jet apparatus of an internal combustion engine that is configured to include an oil jet switching valve that opens and closes an oil path communicated with an oil jet mechanism, wherein the oil jet switching valve includes a valve housing configured to be inserted into an insertion hole that extends in a direction approximately orthogonal to an extending direction of the oil path and configured to be freely movable along an extending direction of the insertion hole;

wherein when the oil jet switching valve is closed, a tip end portion of the valve housing is configured to be pressed to an inner wall surface of the oil path by receiving an energized force from a spring;

wherein a main valve body is inserted in an interior of the valve housing in a freely reciprocating manner, and the main valve body transfers forward, thereby closing an opening formed in the valve housing and blocking the oil path, whereas the main valve body transfers backward, thereby opening the opening and communicating with the oil path, wherein the main valve body is configured to receive the energized force by means of the spring in a forward transfer direction, and when the main valve body transfers forward, the main valve body is in contact with part of an inner surface of the valve housing, thereby applying the energized force of the spring to the valve housing, and when the main valve body transfers backward, the contact of the main valve body with the part of the inner surface of the valve housing is released, thereby not applying the energized force of the spring to the valve housing, and wherein a recess whose shape approximately matches the shape of the tip end portion of the valve housing is formed in a bottom wall of the oil path at a boundary where the valve housing is freely movable in the direction approximately orthogonal to the extending direction of the oil path.

2. The oil jet apparatus of the internal combustion engine according to claim 1, wherein a concave portion having a predetermined length dimension in a direction along an axis of the insertion hole is formed on an inner wall surface of the insertion hole, whereas a protrusion, which is positioned in the concave portion and includes a clearance provided between an inner surface of the concave portion and the protrusion in the direction along the axis, is provided on the outer wall surface of the valve housing, and wherein the valve housing is freely movable only by a dimension of the clearance along the axis in an interior of the insertion hole.

3. The oil jet apparatus of the internal combustion engine according to claim 1, wherein a control valve configured to switch hydraulic pressure, which causes the main valve body inserted into the interior of the valve housing to transfer forward and backward, is provided, and wherein the control valve is configured to include a first port communicated with the oil path that supplies oil discharged from an oil pump to the oil jet mechanism and a second port communicated with a back pressure space of the main valve body, and wherein when the control valve is in a switching state where the first port and the second port are communicated, the hydraulic pressure from the oil path acts in the back pressure space, which causes the main valve body to transfer forward, and the opening formed in the valve housing is closed, thereby blocking the oil path, whereas when the control valve is in a switching state where the first port and the second port are isolated, the hydraulic pressure acted in the back pressure space is released, which causes the main valve body to transfer backward, and the opening is opened, thereby communicating with the oil path.

4. The oil jet apparatus of the internal combustion engine according to claim 3, wherein a drain port is provided in the control valve, the drain port, when the control valve is in the switching state where the first port and the second port are isolated, configured to be communicated with the second port and discharge oil in the back pressure space.

* * * * *